US009276347B2

(12) United States Patent
Wang

(10) Patent No.: US 9,276,347 B2
(45) Date of Patent: Mar. 1, 2016

(54) SOCKET COVER

(71) Applicant: Chih-Tsai Wang, Changhua (TW)

(72) Inventor: Chih-Tsai Wang, Changhua (TW)

( * ) Notice: Subject to any disclaimer, the term of this patent is extended or adjusted under 35 U.S.C. 154(b) by 0 days.

(21) Appl. No.: 14/508,109

(22) Filed: Oct. 7, 2014

(65) Prior Publication Data

US 2015/0104984 A1 Apr. 16, 2015

(30) Foreign Application Priority Data

Oct. 11, 2013 (TW) ..... 102219035 U

(51) Int. Cl.
*H01R 13/46* (2006.01)
*H01R 13/447* (2006.01)
*H01R 24/66* (2011.01)

(52) U.S. Cl.
CPC ..... *H01R 13/447* (2013.01); *H01R 24/66* (2013.01)

(58) Field of Classification Search
CPC .. H01R 24/66; H01R 13/447; H01R 13/4532; H01R 13/4536
USPC ..... 439/113, 134, 135, 136, 142, 521, 528, 439/892, 893; 174/66, 67, 480–490; 220/241, 242
See application file for complete search history.

(56) References Cited

U.S. PATENT DOCUMENTS

| | | | | |
|---|---|---|---|---|
| 3,811,004 | A * | 5/1974 | Moore | 174/67 |
| 5,008,491 | A * | 4/1991 | Bowman | 174/489 |
| 5,582,521 | A * | 12/1996 | Mori et al. | 439/142 |
| 6,265,662 | B1 * | 7/2001 | Riedy et al. | 174/67 |
| 7,183,503 | B2 * | 2/2007 | Bowman et al. | 174/483 |
| 7,635,110 | B2 * | 12/2009 | Galasso et al. | 248/200 |
| 8,357,852 | B2 * | 1/2013 | Drane | 174/66 |
| 8,944,266 | B2 * | 2/2015 | Roemer et al. | 220/3.3 |

* cited by examiner

*Primary Examiner* — Amy Cohen Johnson
*Assistant Examiner* — Milagros Jeancharles

(57) ABSTRACT

A socket cover contains: a cap, a first lid, and a second lid. The cap has an orifice defined thereon, the first lid is disposed on a first side of the orifice of the cap and covers a first part of the orifice, and the first lid has a cutout defined on a non-closed position thereof opposite to the orifice of the cap. The second lid is disposed on a second side of the orifice of the cap and covers a second part of the orifice which is not covered by the first lid, and the second lid has a projection corresponding to the cutout of the first lid. Thereby, when a plug is inserted in a socket, the cap is positioned stably to enhance using safety and aesthetics appearance.

8 Claims, 5 Drawing Sheets

SOCKET COVER

FIELD OF THE INVENTION

The present invention relates to a socket, and more particularly to a socket cover which prevents a plug from a removal and enhances using safety.

BACKGROUND OF THE INVENTION

A conventional socket exposes outside a wall surface or a floor to cause a short circuit as cleaning the floor or the wall surface. In addition, an insertion aperture of the socket exposes a plug, thus removing the plug from the socket easily.

A conventional socket cover is employed to cover the socket and contains an accommodating chamber defined on the wall surface or the floor, wherein the accommodating chamber has a through hole for exposing the socket, and a covering plate is covered on the wall surface or the floor, such that when the covering plate is rotated outwardly, the plug is inserted in the socket and the through hole and does not expose outside the wall surface or the floor. However, a wire of the plug extends out of the covering plate and is connected with an electrical apparatus outside the wall surface or the floor to influence using inconvenience and aesthetics appearance. Furthermore, after reducing a size of the covering plate to extend the wire outwardly, the covering plate cannot close the through hole safely as cleaning the floor or the wall surface.

The present invention has arisen to mitigate and/or obviate the afore-described disadvantages.

SUMMARY OF THE INVENTION

The primary object of the present invention is to provide a socket cover which when a plug is inserted or is not inserted in a socket, the socket cover is positioned stably to enhance using safety.

Another object of the present invention is to provide a socket cover which contains a first lid and a second lid rotated toward a socket to extend a wire of a plug outwardly, and the socket cover does not project out of a floor or a wall surface, thus enhancing the using safety as cleaning the floor or the wall surface.

To obtain the above objects, a socket cover provided by the present invention contains: a cap, a first lid, and a second lid.

The cap has an orifice defined thereon, the first lid is disposed on a first side of the orifice of the cap and covers a first part of the orifice, and the first lid has a cutout defined on a non-closed position thereof opposite to the orifice of the cap. The second lid is disposed on a second side of the orifice of the cap and covers a second part of the orifice which is not covered by the first lid, and the second lid has a projection corresponding to the cutout of the first lid. Thereby, when a plug is inserted in a socket, the cap is positioned stably to enhance using safety and aesthetics appearance.

DETAILED DESCRIPTION OF THE PREFERRED EMBODIMENTS

Figure 1:
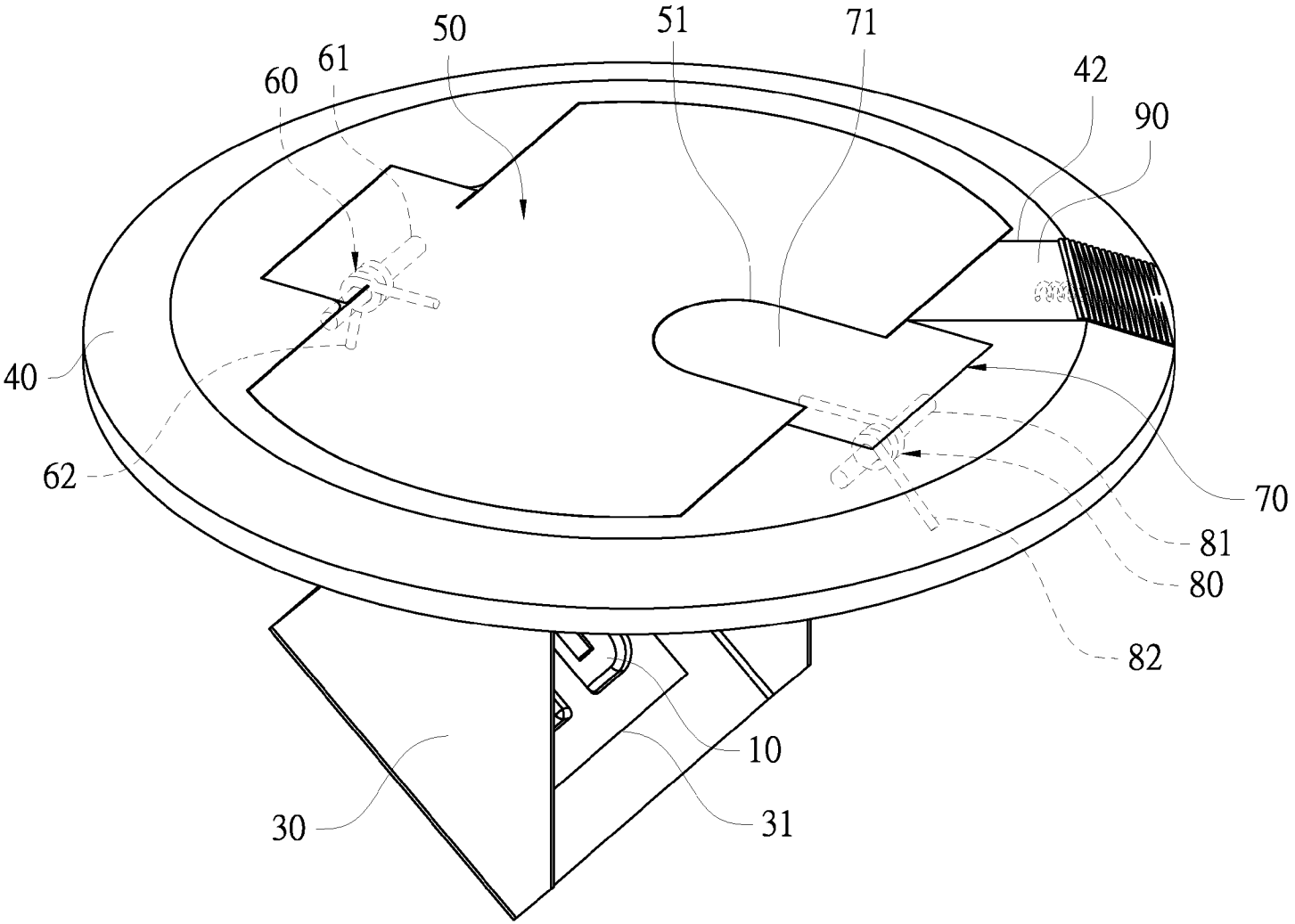
FIG. 1 is a perspective view showing the assembly of a socket cover according to a preferred embodiment of the present invention.
Figure 2:
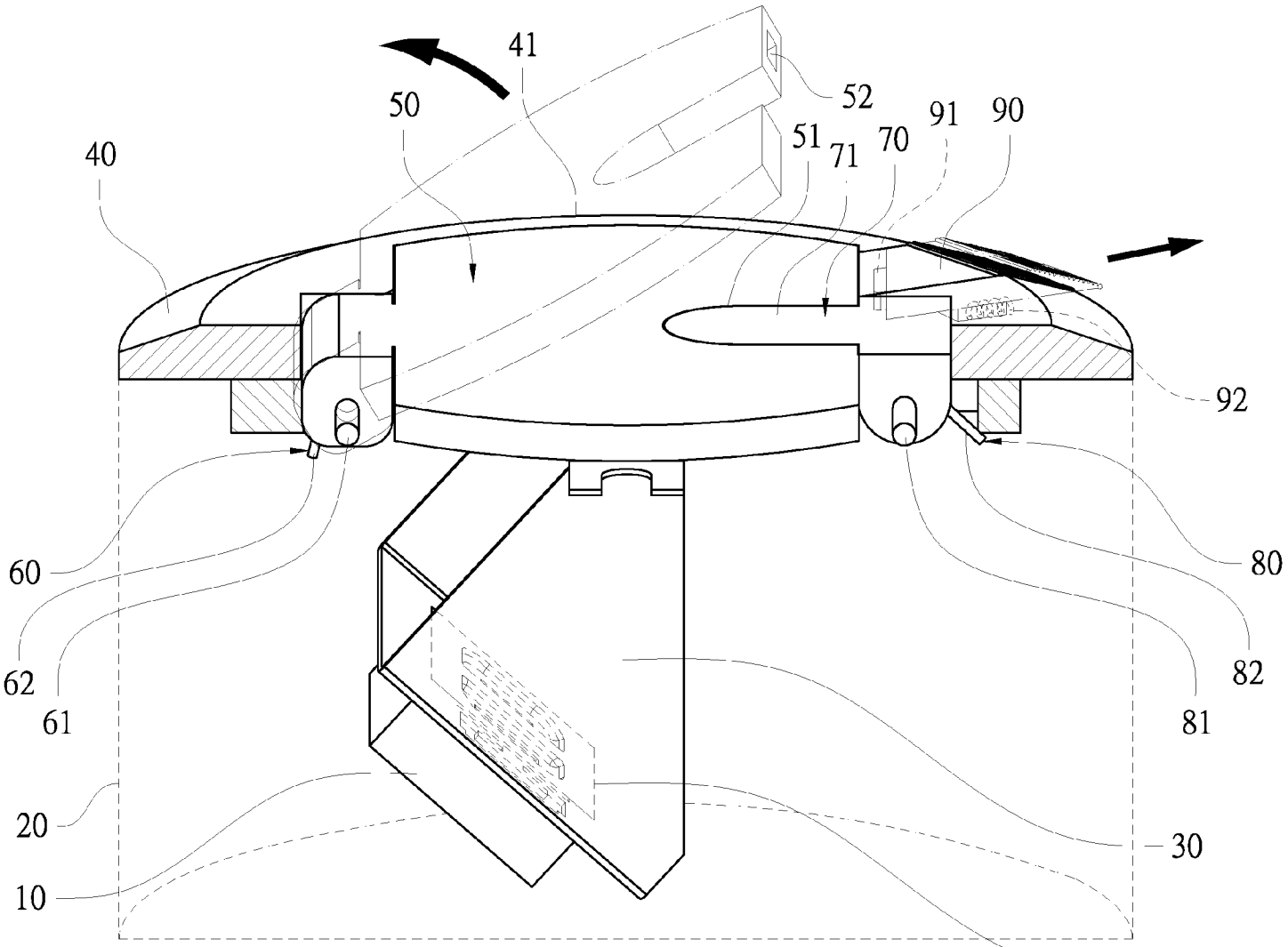
FIG. 2 is a cross-sectional perspective view showing a part of the assembly of the socket cover according to the preferred embodiment of the present invention.

With reference to FIGS. 1 and 2, a socket cover according to a preferred embodiment of the present invention is covered on an accommodating chamber (not shown), and the accommodating chamber includes:

- a socket 10 accommodated in the accommodating chamber;
- a hollow body 20 fixed in the accommodating chamber;
- a holder 30 mounted in the hollow body 20 and having a through hole 31 for exposing the socket 10;
- a cap 40 fixed on the holder 30 and located on a top end of the hollow body 30, the cap 40 having an orifice 41 defined thereon and formed in any one of a circle shape, a rectangle shape, a geometry shape, and an irregular shape, and the cap 40 also having a guiding slot 42 defined on a first side of the orifice 41;
- a first lid 50 disposed on a second side of the orifice 41 of the cap 40 and covering a first part of the orifice 41, the first lid 50 having a cutout 51 defined on a non-closed position thereof opposite to the orifice 41 of the cap 40 and formed in any shape, the first lid 50 also having a recess 52 arranged in one side of one end thereof and facing to the guiding slot 42 of the cap 40;
- a first connection assembly 60 having a first recovering element 62 for abutting against an inner surface of the first lid 50 and a first connecting element 61 for connecting the first lid 50 with the cap 40; wherein the first connecting element 61 is a first connecting shaft, and the first recovering element 62 is a first torsion spring fitted on the first connecting shaft and has a first end positioned on the cap 40 and a second end abutting against the inner surface of the first lid 50, wherein the first torsion spring is pressed in a normal state;
- a second lid 70 disposed on the first side of the orifice 41 of the cap 40 and covering a second part of the orifice 41 which is not covered by the first lid 50, the second lid 70 having a projection 71 corresponding to the cutout 51 of the first lid 50;
- a second connection assembly 80 having a second recovering element 82 for abutting against an inner surface of the second lid 70 and a second connecting element 81 for connecting the second lid 70 with the cap 40; wherein the second connecting element 81 is a second connecting shaft, and the second recovering element 82 is a second torsion spring fitted on the second connecting shaft and has a first end positioned on the cap 40 and a second end abutting against the inner surface of the second lid 70, wherein the second torsion spring is not pressed in the normal state;
- a fixing member 90 mounted in the guiding slot 42 of the cap 40 and closing the orifice 41 with the first lid 50 and the second lid 70, the fixing member 90 having a retaining block 91 corresponding to the recess 52 of the first lid 50 and a resilient element 92 fixed in the fixing member 90 and pushing the retaining block 91 of the fixing member 90 to retain with the recess 52 of the first lid 50, wherein the resilient element 92 is a spring, and a first end of the spring is fixed on the cap 40, a second end of the spring is biased against the fixing member 90.

When the socket cover is not in use, a plug 11 is not inserted in the socket 10, as shown in FIGS. 1 and 2, and the first lid 50 is positioned by retaining the recess 52 with the retaining block 91 of the fixing member 90, and the first lid 50 flushes with the second lid 70, such that the first lid 50 presses the first recovering element 62, and the first lid 50, the second lid 70 and the fixing member 90 close the orifice 41 of the cap 40 completely.

Figure 3:
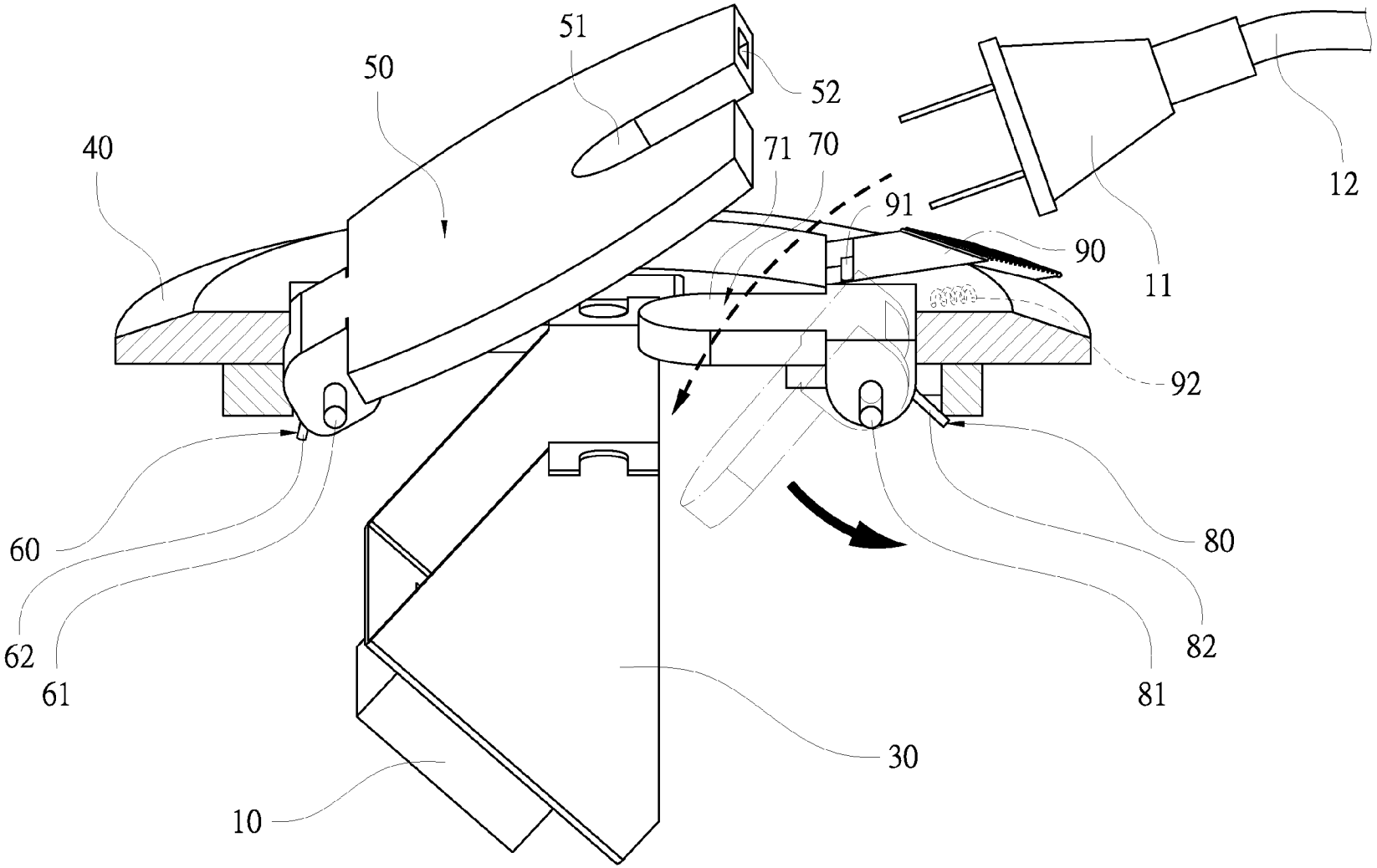
FIG. 3 is a cross-sectional perspective view showing a part of the operation of the socket cover according to the preferred embodiment of the present invention.
Figure 4:
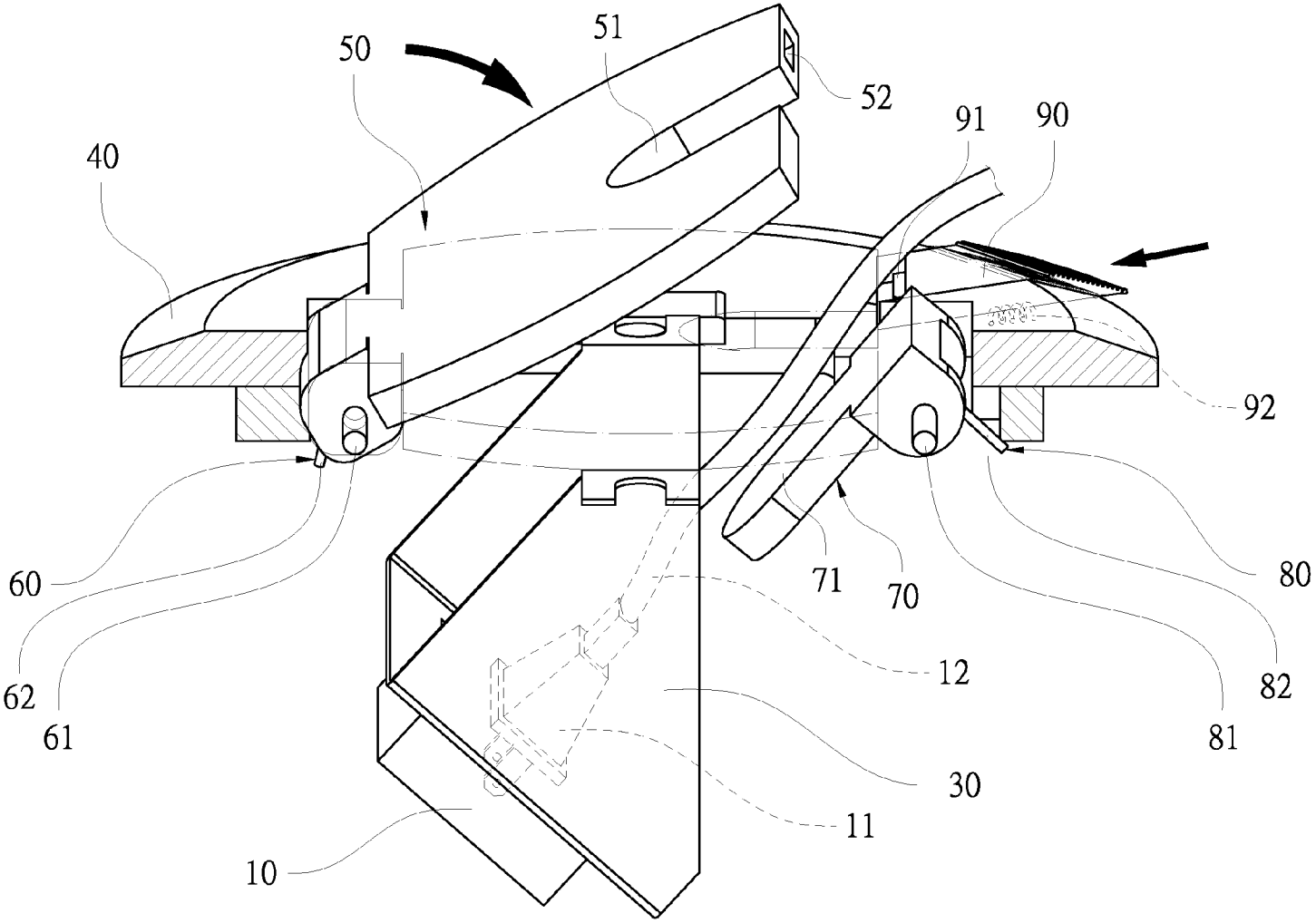
FIG. 4 is another cross-sectional perspective view showing a part of the operation of the socket cover according to the preferred embodiment of the present invention.
Figure 5:
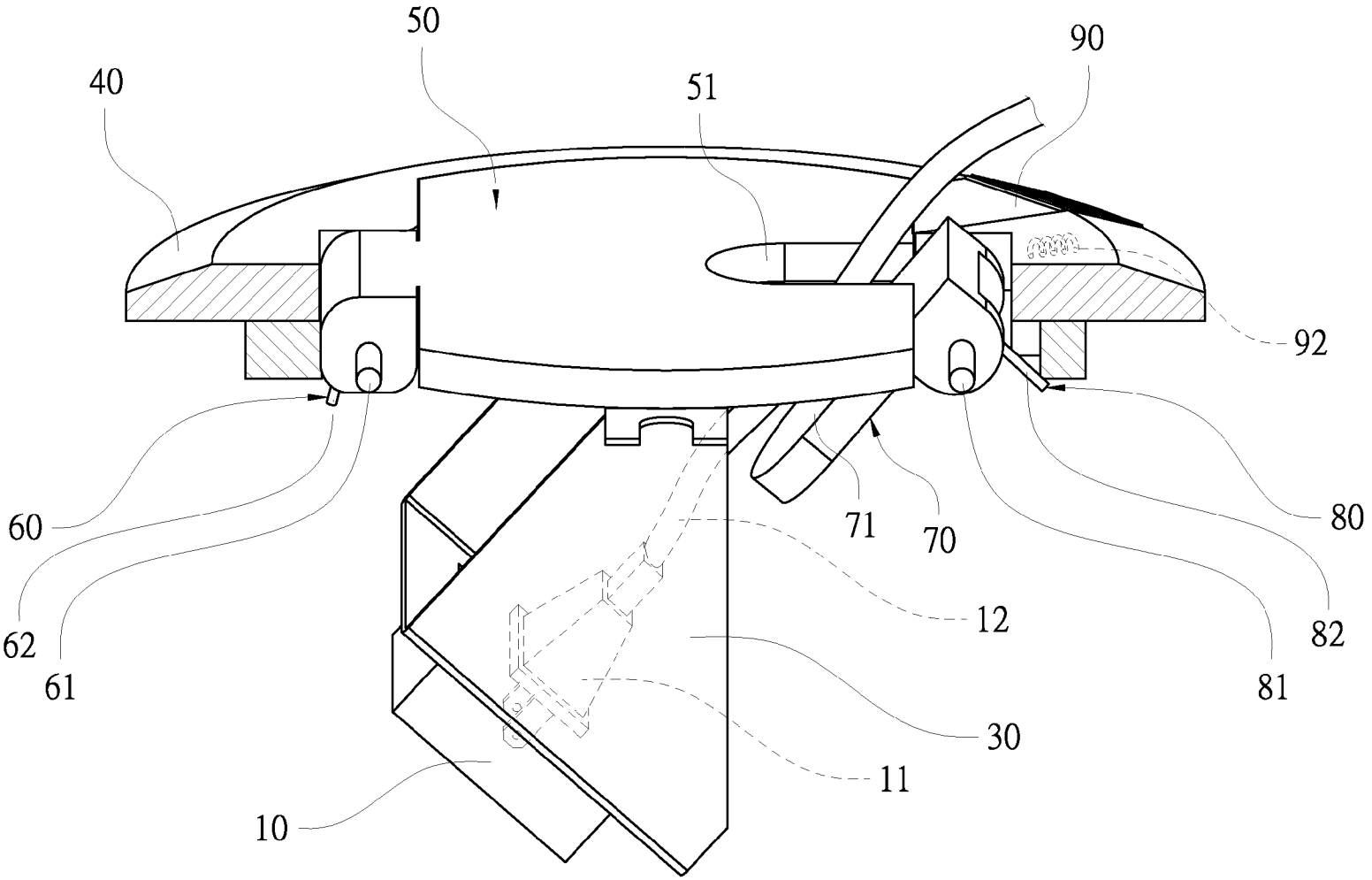
FIG. 5 is also another cross-sectional perspective view showing a part of the operation of the socket cover according to the preferred embodiment of the present invention.

Referring further to FIGS. 3 to 5, when the plug 11 is inserted in the socket 10, the fixing member 60 is pulled outwardly away from the recess 52 to press the resilient element 92, such that the retaining block 91 of the fixing member 90 removes from the recess 52 of the first lid 50, and the first lid 50 is driven by the first recovering element 62 to rotate along the first connecting element 61 and to press the second lid 70 by cooperating with the plug 11, and the second recovering element 82 is pressed by the second lid 70, by which the orifice 41 exposes outside the orifice 41 of the cap 40, hence the plug 11 is inserted in the socket 10 below the cap 40, thereafter the first lid 50 is pressed downwardly to press the first recovering element 62, and the fixing member 90 is released so that the resilient element 92 in the fixing member 90 recovers its elasticity, and the retaining block 91 retains with the recess 52 of the first lid 50, the second lid 70 is pressed downwardly to extend a wire 12 of the plug 11 outwardly, and the first lid 50 covers the orifice 41 flatly, hence when the plug 11 is inserted in the socket 10, the cap 40 is positioned stably to enhance using safety and aesthetics appearance.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A socket cover comprising:

a cap having an orifice defined thereon;

a first lid disposed on a first side of the orifice of the cap and covering a first part of the orifice, the first lid having a cutout defined on a non-closed position thereof opposite to the orifice of the cap;

a second lid disposed on a second side of the orifice of the cap and covering a second part of the orifice which is not covered by the first lid, the second lid having a projection corresponding to the cutout of the first lid;

a first connection assembly having a first recovering element for abutting against an inner surface of the first lid and a first connecting element for connecting the first lid with the cap;

a second connection assembly having a second recovering element for abutting against an inner surface of the second lid and a second connecting element for connecting the second lid with the cap.

2. The socket cover as claimed in claim 1, wherein the cap also has a guiding slot defined on the second side of the orifice and to one side of said second lid, the first lid also has a recess arranged in one side of one end thereof and facing to the guiding slot of the cap, a fixing member is mounted in the guiding slot of the cap and has a retaining block for retaining with or removing from the recess of the first lid.

3. The socket cover as claimed in claim 2, wherein the fixing member, the first lid, and the second lid close the orifice of the cap.

4. The socket cover as claimed in claim 3, wherein the fixing member also has a resilient element fixed therein and pushing the retaining block of the fixing member to retain with the recess of the first lid.

5. The socket cover as claimed in claim 4, wherein the resilient element is a spring, and a first end of the spring is fixed on the cap, a second end of the spring is biased against the fixing member.

6. The socket cover as claimed in claim 1, wherein the first connecting element is a first connecting shaft, and the first recovering element is a first torsion spring fitted on the first connecting shaft and has a first end positioned on the cap and a second end abutting against the inner surface of the first lid, wherein the first torsion spring is pressed in a normal state.

7. The socket cover as claimed in claim 1, wherein the second connecting element is a second connecting shaft, and the second recovering element is a second torsion spring fitted on the second connecting shaft and has a first end positioned on the cap and a second end abutting against the inner surface of the second lid, wherein the second torsion spring is not pressed in a normal state.

8. The socket cover as claimed in claim 1 further comprising a hollow body fixed in an accommodating chamber and a holder mounted in the hollow body, wherein the holder has a through hole for exposing the socket, and the cap is fixed on the holder and is located on a top end of hollow body.

* * * * *